US009500450B2

(12) United States Patent
Kireev

(10) Patent No.: US 9,500,450 B2
(45) Date of Patent: Nov. 22, 2016

(54) SPECIAL CARTRIDGE (VARIANTS)

(71) Applicant: Nikolay Nikolaevich Kireev, Sergiev Posad (RU)

(72) Inventor: Nikolay Nikolaevich Kireev, Sergiev Posad (RU)

( * ) Notice: Subject to any disclaimer, the term of this patent is extended or adjusted under 35 U.S.C. 154(b) by 0 days.

(21) Appl. No.: 14/812,631

(22) Filed: Jul. 29, 2015

(65) Prior Publication Data

US 2015/0330752 A1 Nov. 19, 2015

Related U.S. Application Data

(62) Division of application No. 14/375,770, filed as application No. PCT/RU2013/000079 on Feb. 4, 2013.

(30) Foreign Application Priority Data

Feb. 7, 2012 (RU) ..... 2012104186

(51) Int. Cl.
*F42B 12/40* (2006.01)
*F42B 5/02* (2006.01)
(Continued)

(52) U.S. Cl.
CPC . *F42B 5/02* (2013.01); *F42B 7/02* (2013.01); *F42B 8/02* (2013.01); *F42B 12/40* (2013.01)

(58) Field of Classification Search
CPC ..... F42B 5/02; F42B 7/02; F42B 8/02; F42B 12/40; F42B 39/20
USPC ..... 102/439, 441, 444, 464, 502, 511, 512, 102/513; 124/57
See application file for complete search history.

(56) References Cited

U.S. PATENT DOCUMENTS 2,535,624 A * 12/1950 Burney ..... F42B 5/05 102/430
2,987,965 A * 6/1961 Musser ..... F42B 5/05 102/464

(Continued)

FOREIGN PATENT DOCUMENTS

EP 1387143 A1 2/2004
RU 66506 U1 9/2007

OTHER PUBLICATIONS

International Search Report; PCT/RU2013/000079; May 23, 2013.

*Primary Examiner* — Bret Hayes
(74) *Attorney, Agent, or Firm* — Studebaker & Brackett PC

(57) ABSTRACT

The invention relates to a weapon intended for fighting games, mainly for paintball, namely to special cartridges containing painting liquid. The special cartridge contains a cartridge case 1 that includes a propellant charge 2, a projectile 3 and a primer cap 4. The cartridge case 1 has inside a rigidly fixed nozzle 5 (variants 1, 3) for supplying a portion of the gas stream at the projectile 3 or a solid partition 7 (variant 2). The cylindrical cartridge case body 1 is provided with holes 6 on the side of the primer cap 4 that are intended to direct the gas flow (variants 1-3); in addition, the mouth of the cartridge case is also provided with holes 8 for directing the gas flow (variants 2, 3). The areas of the holes of the nozzle 5 and the total surfaces of the holes 6 and 8 are of different size. To carry out firing process, the primer cap 4 is impacted, which ignites the propellant charge 2; the larger portion of the gas stream formed during combustion of the propellant is directed through the holes 6 in the weapon bore, thus creating a main effect of shot (sound, flame). The lesser gas stream formed by combustion of the propellant charge 2 is directed to the projectile 3 and imparts to it the required acceleration, while maintaining the integrity of its shape and volume. The projectile 3 is made as a tagging one; a bead that is identical to that used in a paintball game can be used as such a projectile. Furthermore, the projectile 3 is designed as a container, inside which any filler, for example, an antiseptic agent, can be located.

2 Claims, 1 Drawing Sheet

(51) Int. Cl.
*F42B 7/02* (2006.01)
*F42B 8/02* (2006.01)

(56) References Cited

U.S. PATENT DOCUMENTS 2,996,988 A * 8/1961 Kunz ..... F42B 5/025 102/433
3,568,599 A * 3/1971 Dardick ..... F42B 5/05 102/434
3,892,181 A * 7/1975 Goldin ..... F42B 5/045 102/434
4,907,510 A * 3/1990 Martwick ..... F42B 5/045 102/430
5,959,235 A * 9/1999 Wagstaff ..... F02K 9/38 102/202
7,484,353 B1 * 2/2009 Figge, Sr. ..... F02K 9/34 102/374
2005/0183612 A1 * 8/2005 Huffman ..... F42B 5/045 102/434
2007/0119329 A1 * 5/2007 Haeselich ..... F42B 8/12 102/498
2010/0269724 A1 * 10/2010 Head ..... F42B 8/02 102/447
2011/0079164 A1 4/2011 Broden et al.
2012/0255456 A1 * 10/2012 Fink ..... B23P 11/00 102/481

* cited by examiner

SPECIAL CARTRIDGE (VARIANTS)

The invention relates to arms for military sports games, such as air soft and paintball, namely to special cartridges using painting liquid.

There is known a balloon with painting fluid, such as for playing paintball, comprising a flexible shell, inside which the painting liquid is placed (U.S. Pat. No. 5,878,736, cl. F41B 11/00, 1999). This known ball has low strength characteristics for the use in conjunction with a gun powder charge (in a standard design cartridge) and does not allow to fully create the effects of using military weapons at active games.

The closest to the proposed invention by the total essential signs is a cartridge for shotguns containing a cartridge case, inside which is placed a propelling charge, a projectile and a primer cap as per the patent of the Russian Federation No. 99869 for utility model, cl. F42B 7/08, 2010.

The challenge of the proposed invention is to provide a special cartridge, which allows shooting by tagging elements to give effects of military weapons, such as the sound of the shot, outputting flame from a barrel, recoil, cartridge case extraction, automatic shooting etc.

The technical result of using the proposed group of inventions is the creation, when shooting with tagging elements, of the effect obtained when using military weapons.

The said technical result is achieved by the fact that the special cartridge (variant 1) includes a cartridge case, a propelling charge, a projectile, and a primer cap, is provided with a nozzle for guiding the smaller portion of the gas stream at the projectile, wherein through holes for the output of a greater gas flow portion are made in a cylindrical cartridge case body, on the side of the primer cap, wherein the total area of the holes for the output of a greater gas flow portion is larger than the minimum area of the nozzle hole fixedly secured in the cartridge case, and the projectile is tagging one. Furthermore, the projectile is designed as a container.

The said technical result is achieved by the fact that the special cartridge (variant 2) includes a cartridge case, a propelling charge, and a projectile, and a primer cap, is provided with a baffle plate that is solid and fixedly secured inside the cartridge case, in the cylindrical body of which, on both sides of the partition, through holes are made, wherein the total area of the holes located on the primer cap side is larger than the total area of the holes located in the mouth of the cartridge case, and the projectile is tagging one. Furthermore, the projectile is designed as a container.

The said technical result is achieved by the fact that the special cartridge (variant 3) includes a cartridge case, a propelling charge, a projectile, and a primer cap, is provided with a nozzle for directing the flow of gas at the projectile, wherein through holes are made in the cylindrical cartridge case body, on both sides of the nozzle fixedly secured in the cartridge case, wherein the total area of the holes located on the side of the primer cap is larger than the total area of the holes located in the cartridge case mouth, and the projectile is tagging one. Furthermore, the projectile is designed as a container.

The invention is illustrated by the following drawings.

Figure 1:
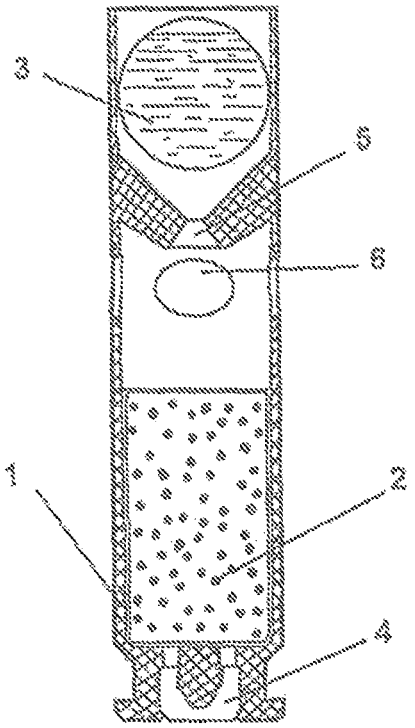
FIG. 1 shows a special cartridge, variant 1.
Figure 2:
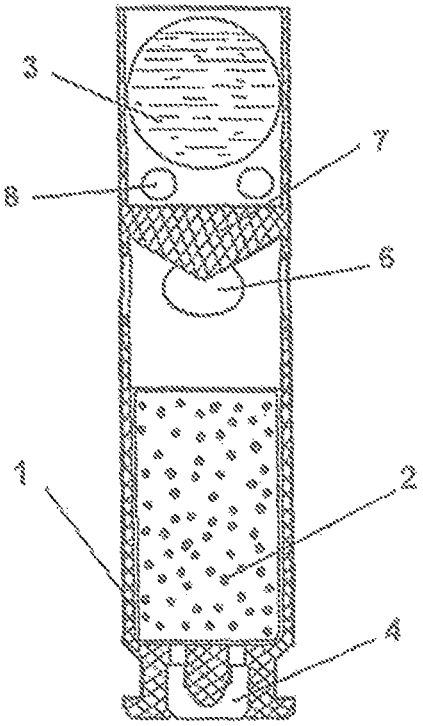
FIG. 2 shows a special cartridge, variant 2.
Figure 3:
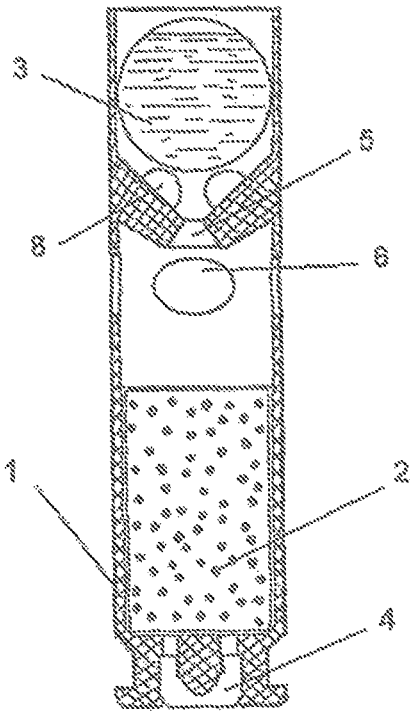
FIG. 3 shows a special cartridge, variant 3.

The special cartridge (variant 1) includes a cartridge case 1, inside which a propellant charge 2 that is a solid powder charge insulated from the effects of environment, a projectile 3 and a primer cap 4. A nozzle 5 is installed and fixedly secured inside the cartridge case 1; this nozzle is intended to direct ales ser portion of the gas stream at the projectile 3. Through holes 6 to output the most portion of the gas flow are made in the cylindrical body of the cartridge case 1, on the side of the primer cap 4, wherein the total area $S_1$ of the holes 6 for the output of a larger portion of the gas flow is larger than the area $S_2$ of the minimum nozzle hole 5.

The projectile 3 is made as a tagging one; a bead that is similar to one used in paintball game can be used as a tagging element in this cartridge design. Furthermore, the projectile 3 is made as a container, inside which there may be any filler, for example, antiseptic substance.

The special cartridge (variant 2) includes a cartridge case 1, inside which propellant charge 2 is located that is a solid powder charge insulated from the effects of environment, a projectile 3 and a primer cap 4. A partition 7 is installed in the cartridge case 1 fixedly secure din side the cartridge case 1 and made as a solid one. Through holes 6 and holes 8 are made in the cylindrical body of the cartridge case 1 on both sides of partition 7, wherein the total area $S_1$ of the holes 6 located on the side of the primer cap 4 is larger the total area $S_3$ of holes 8 arranged in the mouth portion of the cartridge case 1.

The projectile 3 is made as a tagging one; a bead that is similar to one used in paintball game can be used as a tagging element in this cartridge design. Furthermore, the projectile 3 is made as a container, inside which there may be any filler, for example, antiseptic substance.

The special cartridge (variant 3) includes a cartridge case 1, inside which propellant charge 2 is located, which is a solid powder charge insulated from the effects of environment, a projectile 3 and a primer cap 4. A nozzle 5 intended to direct a lesser portion of the gas flow at the projectile 3 is located and fixedly secured inside the cartridge case 1. Through holes 6 to output the most portion of the gas flow are made in the cylindrical body of the cartridge case 1, on the side of the primer cap 4, wherein the total area $S_1$ of the holes 6 for the output of a larger portion of the gas flow is more than the area $S_2$ of the minimum nozzle hole 5. Through holes 6 and through holes 8 are made in the cylindrical cartridge case body 1 on both sides of the nozzle 5, wherein the total area $S_1$ of the holes 6 arranged on the side of the primer cap 4 is larger than the total area $S_3$ of the holes located in the mouth of the cartridge case 1.

The projectile 3 is made as a tagging one; a bead that is similar to one used in paintball game can be used as a tagging element in this cartridge design. Furthermore, the projectile 3 is made as a container, inside which there may be any filler, for example, antiseptic substance.

The special cartridge (variant 1) works as follows. To perform the firing process, the primer cap 4 is impacted, which in turn ignites the propellant charge 2; a larger portion of the gas stream formed during combustion of the propellant charge is directed through the holes 6 in the weapon bore, thus creating a main shot effect (sound, flame), as well a portion energy of this gas stream is spent to actuate the weapons automation for the automatic recharge. A smaller portion of the gas stream formed in the combustion of the propellant charge 2 is directed through the nozzle 5 to the projectile 3 and impart to it the required acceleration, while maintaining the integrity of its shape and volume, thus we obtain a maximum effect of the shot. As the tagging projectile 3 hits the target the bead shell tears, and the painting liquid leaves a clear trace of the hit.

The special cartridge (variant 2) works as follows. To perform the firing process, the primer cap 4 is impacted, which in turn ignites the propellant charge 2; the gas formed during the combustion of the propellant charge goes through the holes 6 out of the cartridge case 1 and distributes as follows: one portion goes into the bore of the weapons, thus creating a main effect of shot (sound, flame), a portion of the energy of this gas is consumed for work of the weapon automation for the automatic recharge, and the other portion directed through the holes 8 to the projectile 3 and imparts to it the required acceleration, while maintaining the integrity of its shape and volume, thus we obtain a maximum effect of the shot. As the tagging projectile 3 hits the target, the bead shell tears, and the painting liquid leaves a clear trace of the hit.

The special cartridge (variant 3) works as follows. To perform the firing process, the primer cap 4 is impacted, which in turn ignites the propellant charge 2; the gas formed during the combustion of the propellant charge 2 is divided into two streams and distributes as follows: a portion of the first flow goes through the holes 6 out of the cartridge case 1 and is guided in the bore of the weapon, thereby creating a main effect of shot (sound flame); a portion of energy of this gas is spent to actuate the weapon automation for automatic reloading, the second portion of the flow is directed through the nozzle 5 to the projectile 3 and impart to it the required initial acceleration, while maintaining the integrity of its shape and volume; a portion of the first gas flow hits through the holes 8 to the projectile too, while imparting to it an additional acceleration. As the tagging projectile 3 hits the target, the bead shell tears, and the painting liquid leaves a clear trace of the hit.

The invention claimed is:

1. A cartridge comprising:

a cartridge case;

propellant powder;

a projectile; and a primer cap;

wherein the cartridge case comprises a cylindrical body and includes a nozzle fixedly provided in the cylindrical body and positioned between a primer cap portion of the cylindrical body and an opposite, mouth portion of the cylindrical body;

wherein the nozzle directs a portion of a gas stream toward the projectile;

wherein, on opposite sides of the nozzle, pluralities of through-holes are disposed in the cylindrical body; and wherein a total area of the through-holes on the primer cap portion is greater than a total area of the through-holes on the mouth portion.

2. The cartridge according to claim 1, wherein the projectile is designed as a container.

* * * * *